US005598607A

United States Patent [19]

Katagiri

[11] Patent Number: 5,598,607

[45] Date of Patent: Feb. 4, 1997

[54] CLOSING CONTROL AND OPENING FREE ASSEMBLY FOR A HINGE CONNECTION

[75] Inventor: Takashi Katagiri, Tokushima, Japan

[73] Assignee: Santo Industries Co., Ltd., Japan

[21] Appl. No.: 505,861

[22] Filed: Jul. 24, 1995

[30] Foreign Application Priority Data

Jul. 27, 1994 [JP] Japan ..... 6-196128

[51] Int. Cl.[6] ..... E05C 17/64; E05D 11/08

[52] U.S. Cl. ..... 16/337; 16/338

[58] Field of Search ..... 16/342, 334, 337, 16/338, 339, 340, 341, 374, 375, 344, 321, 325

[56] References Cited

U.S. PATENT DOCUMENTS

| | | | |
|---|---|---|---|
| 1,638,065 | 8/1927 | Simon | 16/338 |
| 1,956,040 | 4/1934 | Meyer | 16/340 |
| 2,260,403 | 10/1941 | Preston | 16/338 |
| 4,829,633 | 5/1989 | Kassner | 16/340 |
| 5,165,509 | 11/1992 | Kanno | 16/342 |
| 5,276,945 | 1/1994 | Matsumura | 16/337 |
| 5,333,356 | 8/1994 | Katagiri | 16/342 |

FOREIGN PATENT DOCUMENTS

| | | | |
|---|---|---|---|
| 89382 | 10/1960 | Denmark | 16/342 |
| 468922 | 7/1937 | United Kingdom | 16/342 |

*Primary Examiner*—Chuck Y. Mah

[57] ABSTRACT

A closing control and opening free assembly for a hinge connection is mounted within various articles of furniture or implements. The assembly has a mounting element having a circular hole, a pivot member or rotor disk connected therewith, the circumference of which gets into contact with the inside surface of the circular hole, one or more pair of spring and roller positioned in each of recess formed on the periphery of the circular hole or the pivot member, and a brake component. When opening a rotatable section upward, the pivot can rotate together with the brake component, and thus it is possible to open freely the rotatable section. When closing the rotatable section downward, the pivot can not rotate with the brake component. Consequently, the rotatable section is rested at a desired turning position.

9 Claims, 4 Drawing Sheets

CLOSING CONTROL AND OPENING FREE ASSEMBLY FOR A HINGE CONNECTION

BACKGROUND OF THE INVENTION

The present invention relates a control assembly for a hinge connection, and more particularly to a closing control and opening free assembly for a hinge connection employed for a rotatable section such as a fallboard of pianos, a slant or drop front of desks, a display unit of notebook-sized computers, a stand for portable television set, and the like.

In a general household and office, there are various articles of furniture or implements which have a rotatable section in the up-down direction by means of the plural number of hinges or other turning fittings. Such simple hinge can turn freely in the up-down direction and is usually used for a rotatable section, for example, a fallboard of pianos, a slant or drop front of desks, a paper cutter, and a seat cover of toilet seats. When the rotatable section is closed suddenly, there is a danger of nipping and injuring a finger in the rotatable section. On such an occasion, the rotatable section suffers a slight or heavy damage.

Therefore, lap top, palm top or handy personal computers having a small display unit with a liquid crystal panel are required to be provided with an assembly for controlling the turn of a pivot attached to a hinge to be in control of opening and closing and keep from damaging them. The known control assembly used for opening and closing the display unit has a thick coiled spring fastened around the hinge pivot and both ends of the coiled spring are fixed to the holding member. As the pivot is tightened with strong torsion of the spring, the display unit rests at a desired opening position. With relation to the known assembly, about two times the force is required to start the opening and closing motion as compared with the turning movement of the display unit, as it is impossible to control the opening and closing motion due to constant tightening of the hinge pivot with uniform strong torsion. In case the opening and closing motion of the display unit are carried out repeatedly, a contact part of the pivot with the spring is worn out and frictional resistance in the hinge increases more and more as metal grounds enter the contact part. Consequently, the opening and closing motion of the display unit become difficult.

According to handy personal computers with a display unit, I have already proposed novel control assembly for hinge connection, in U.S. Pat. No. 5,333,356 and U.S. Pat. application Ser. No. 299,754 in the capacity of one of inventors. By the use of the assembly, the display unit can be easily and smoothly closed by hand and rested the section at a desired turning position. However, it is difficult to open a heavy fallboard of a piano or a slant or drop front of a desk easily and smoothly when it is opened.

SUMMARY OF THE INVENTION

The present invention provides a closing control and opening free assembly for a hinge connection between a first segment and a second segment. The hinge connection may be used for a fallboard of a piano as shown in FIG. 1, a slant or drop front of a desk as shown in FIG. 2, a paper cutter as shown partly in FIG. 7 and a seat cover of a toilet seat, a notebook-sized computer with a display unit as shown in FIG. 14, or electric goods with a rotatable section. Also, the assembly of this invention may be applied to a window or a rotatable section mounted to various articles of furniture or automobile. It is possible to arrange the assembly for one or both of the hinge connections, e.g., one or both side connections between a slant or drop front and a desk body.

The assembly comprises a mounting element having a circular hole fixedly secured to the first segment, e.g., a piano arm, a slant or drop front or a desk body, an elongated pivot or rotor disk connected therewith, the circumference of which gets into contact with the inside surface of the circular hole, one or more pair of spring and small roller or catching positioned in each of the recess formed on the periphery of the circular hole or the pivot member at equal circumferential distances.

The assembly further has a brake member disposed around a rear portion of the pivot member, a holding member fixedly secured to the second segment, e.g., a fallboard, the desk body or the slant or drop front, and adjusting means for clamping the holding member. The holding and brake members have a barrel portion and two leaf portions, respectively. The inner surface of the holding member corresponds substantially to the outer surface of the brake member. The brake member may be usually made of hard plastics, e.g., engineering plastics that is excellent in durability, and the holding member may be made of spring steel. When observed the holding and brake members from the side, preferably the lower leaf portion extends along a tangent line of the circular barrel portion, and the upper leaf portion extends parallel to the lower leaf portion with a desired distance. The adjusting means may be a screw or bolt put in each slot of the upper and/or lower leaf portions of the holding and the brake members. By tightening the screw or bolt, the barrel portion of the holding member is so clamped radially that the brake member is effectively urged against the pivot. The clamping of the brake member down on the pivot is adjustable by tightening or loosening with the screw or bolt.

Instead of the brake component mentioned above, the assembly may further have a brake sleeve disposed around a rear portion of the pivot member, a socket member disposed around the rear portion of the pivot member for engaging an edge portion of the brake sleeve, adjusting means for urging the socket member against the sleeve so that the socket member compresses the sleeve radially into friction contact with the pivot member, and connecting means for connecting either the brake sleeve or the socket member with the second segment. The brake sleeve may be rotatable about the pivot member and defines a central aperture and at least one slot disposed axially of the central aperture. The socket member may define a central frustconical aperture and the brake sleeve includes a tapered portion which extends into the frustconical apertures of the socket member. The adjusting member may include a nut disposed around the pivot member and further include a spring disposed between the nut and the socket member. The connecting means include a housing disposed around the sleeve and at least one stop mounted to the housing and extending into an opening defined by the sleeve. The connecting means prevent relative rotational movement between the sleeve or the socket member and the second segment.

The various aspects of the invention will be more fully understood when the following portions of the specification are read in conjunction with accompanying drawings wherein:

It is accordingly the object of the invention to provide a closing control and opening free assembly for a hinge connection adapted to various articles of furniture, implements and the like which have a rotatable section in the up-down direction.

It is the another object of the invention to provide an assembly for opening freely if heavy, closing easily and smoothly a rotatable section of a hinge connection by hand and resting the section at a desired turning position.

It is still another object of the invention to provide a closing control and opening free assembly, which is relatively simple and inexpensive.

These and other objects, features and advantages of the invention will become more apparent to those skilled in the art from the following description.

DETAILED DESCRIPTION OF THIS INVENTION

Figure 1:
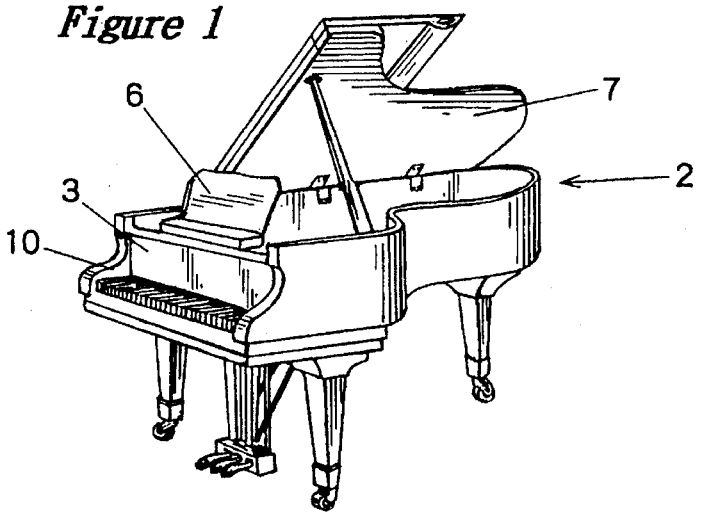
FIG. 1 is a schematic perspective view of a grand piano with the assembly of this invention.

Referring to the drawings, FIGS. 3 to 6 illustrate the general organization of an assembly 1 according to the present invention. In order to mount the assembly 1 on a rotatable section, i.e., a fallboard 3, a music rack 6 or a back lid 7 of a grand piano 2 as seen in FIG. 1, a holding member 19 is fixedly bolted on the lower portion of the fallboard 3. The assembly 1 has a brake member 15 and a holding member 19. The brake member 15 is an injection molding made of wear-resistant engineering plastics, e.g., polyacetal resin containing carbon fiber. The holding member 19 is made of spring steel.

The holding member 19 has a barrel portion 48 and two leaf portions 41 and 42. When observed the holding member 19 from the side, as shown FIG. 5, the lower leaf 42 extends along a tangent line of the circular barrel portion 48, and the upper leaf 41 extends parallel to the lower leaf 42 with a desired distance. The lower leaf 42 is generally much longer than the upper leaf 41. In this Example, the leaf portions 41 and 42 are generally the same width as the barrel portion 48. A penetration slot 43 or 44 for an adjusting screw 20 is made in the leaves 41 and 42, respectively, and the slot 43 aligning vertically with the slot 44. The lower leaf 42 only has two penetration bolt holes 51 and 51.

Figure 5:
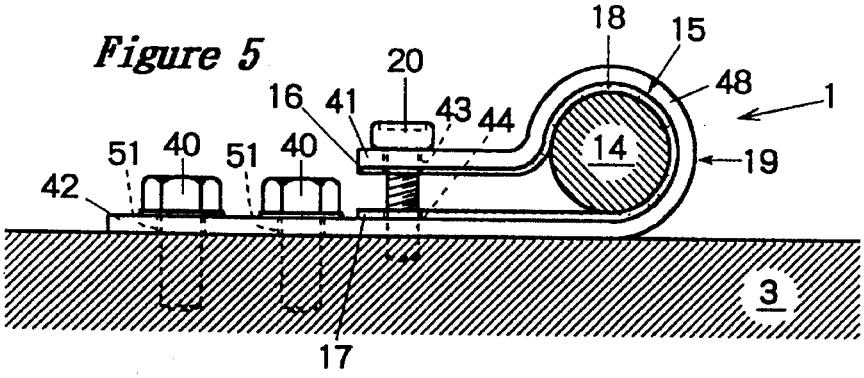
FIG. 5 is an enlarged cross sectional view of taken on line A—A of FIG. 3.
Figure 6:
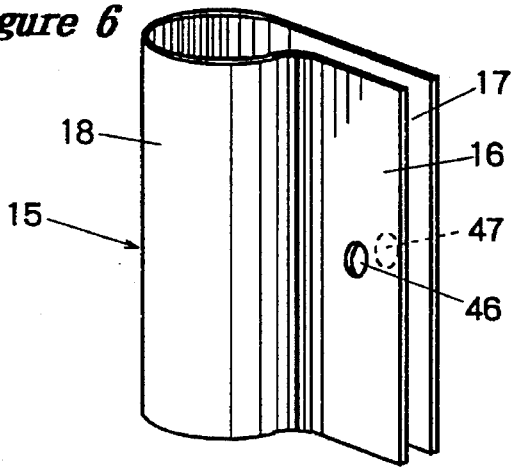
FIG. 6 is an enlarged perspective view of a brake member used in the assembly shown in FIG. 3.

As shown in FIGS. 5 and 6, the brake member 15 as similar shape as the holding member 19 is arranged therewithin. The outer surface of a barrel 18 of the brake 15 corresponds to the inner surface of the holding barrel 48. Usually the width of the brake member 15 is as the same as that of the holding member 19. The upper leaf 16 is the same length as the upper leaf 41, but the lower leaf 17 is shorter than the lower leaf 42. The leaves 16 and 17 of the brake 15 have a penetration slot 46 or 47 for an adjusting screw 20, respectively, the slots 46 and 47 thereof aligning vertically with the slots 43 and 44 of the holding member 19.

The adjusting screw 20 having a cross recessed head is put in the slots 43, 46, 47 and 44 of the leaves of the holding and brake members 19 and 15. For attaching the screw 20 to the holding member 19, the slot 44 is tapped and/or a tapped hole is formed on the projection under the slot 44.

An elongated pivot 14 is rotatably put in the barrel portion 18 of the brake member 15. The pivot 14 projects from the one side of the holding member 19. A circumferential groove (not shown) for E-shaped fittings 53 is formed on the rear edge of the pivot 14. The E-shaped fittings 53 are attached to the circumferential groove to hold a washer 54. A collar 52 and fittings 53 are placed on both sides of the holding member 19 to prevent the pivot 14 from coming off the holding member 19. On a threaded end 12 (see FIG. 3) of the pivot 14, there is generally formed to a heterogeneous cross-section such as a rectangular or square section **12*a* (see FIG. 4**).

Figure 4:
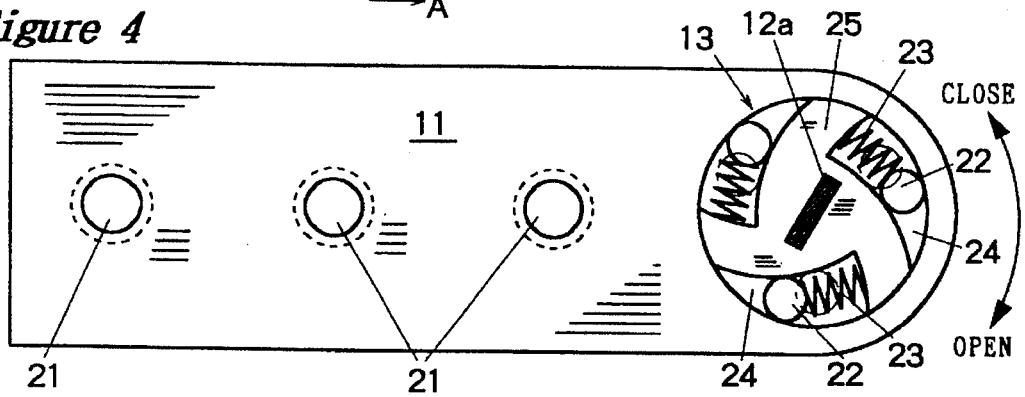
FIG. 4 is an enlarged side view of a mounting plate in cross section of the pivot member of the assembly, illustrating the direction of movement of the mounting plate.

As seen in FIG. 4, a mounting element 11 has a circular hole 13 on the end portion thereof and two or more countersinks 21. The plate 11 is about 3 mm. thick. The plate 11 is held on an adjacent side of a piano arm 10 by means of flat head screws (not shown) and/or adhesive. The threaded end 12 of the pivot 14 inserted into a rectangular center hole of a rotor disk 25, and then a nut 55 is tightened on the threaded end 12 so that the rotor disk 25 is located in the circular hole 13. Three recesses 24 having nearly right triangular side-view are formed on the periphery of the rotor disk 25 at equal circumferential distances. Three pairs of coiled spring 23 and small roller 22 or cylinder are positioned in each of the recess 24 so that each spring 23 urges the roller 22 forward.

The assembly 1 is fixedly secured on one side of the lower portion of the fallboard 3 by tightening tap bolts 40 and 40 into the tapped holes formed on the lower portion of the fallboard 3. On the other side of the lower portion of the fallboard 3, another assembly 1 or pivot (now shown) is rotatably mounted in the same means. The assembly 1 is positioned vertically so that the pivot 14 of each assembly 1 are disposed coaxially on the fallboard 3.

When opening the fallboard 3, the holding and brake members 19 and 15 and the pivot 14 begin to turn simultaneously because the assembly 1 rotates with the fallboard 3. At the same time as the rotor disk 25 connected with the pivot 14 begin to rotate clockwise in FIG. 4, each roller 22 is moved to the wider space in the recess 24 against the coiled spring 23, and thus the pivot 14 can rotate together with the holding and brake members 19 and 15. Therefore, it is possible to open freely the fallboard 3 clockwise in FIG. 4.

When closing the fallboard 3, the holding and brake members 19 and 15 begin to turn simultaneously. At the same time as the rotor disk 25 begin to rotate counterclockwise in FIG. 4, each roller 22 is moved to the narrower space in the recess 24 by means of the spring 23, and thus the pivot 14 can not rotate and rests in the brake barrel 18. Since the holding member 19 is clamped inward by tightening the screw 20, the brake member 15 is compressed radially inward and contracts easily against the pivot 14. As this result, the brake 15 clamps down on the pivot 14 and rests the fallboard 3 at a desired turning position. Since the inner surface of the brake member 15 is slid on the circumference of the pivot 14, the compressed brake 15 keeps effectively the closing of the fallboard 3 under control. The effect of the brake 15 which clamps down on the pivot 14 for the fallboard 3 is easily adjustable by tightening or loosening with the screw 20.

Figure 7:
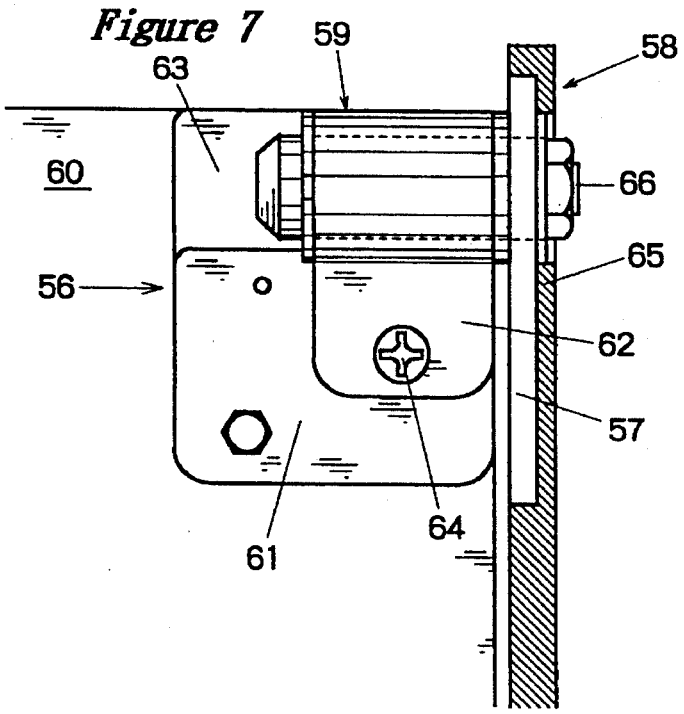
FIG. 7 is a partial horizontal sectional view of a paper cutter.
Figure 3:
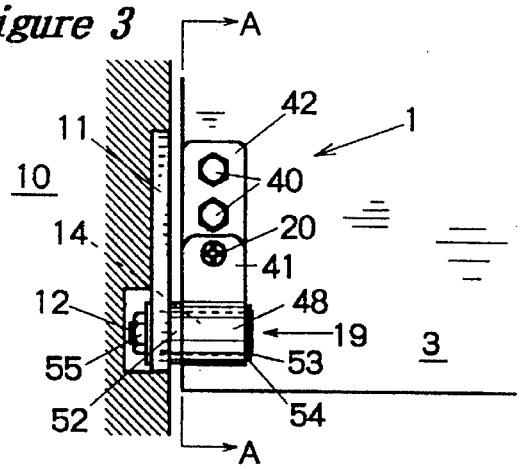
FIG. 3 is a partial horizontal sectional view of the piano shown in FIG. 1.

The embodiment of FIG. 7 is similar to that above described with the exception that it is provided with a flat support plate 63. According to this assembly 56 for a paper cutter 58, a tapped hole for tightening an adjusting screw 64 is made in the plate 63 and a penetration slot is made in two leaves of a holding member 59 and a brake member (not shown). In this Example, a lower leaf 61 of the holding member 59 is much wider than an upper leaf 62 thereof. In order to mount the assembly 56 on a cutter body 60, the members 59 and 63 are fixedly bolted on a corner of the cutter body 60. A mounting plate 57 is held on the side of a cutter blade 65 by means of flat head bolts. The threaded end of a pivot 66 is inserted into a rectangular center hole of a rotor disk(not shown), and then a nut 55 is tightened on said threaded end.

Figure 8:
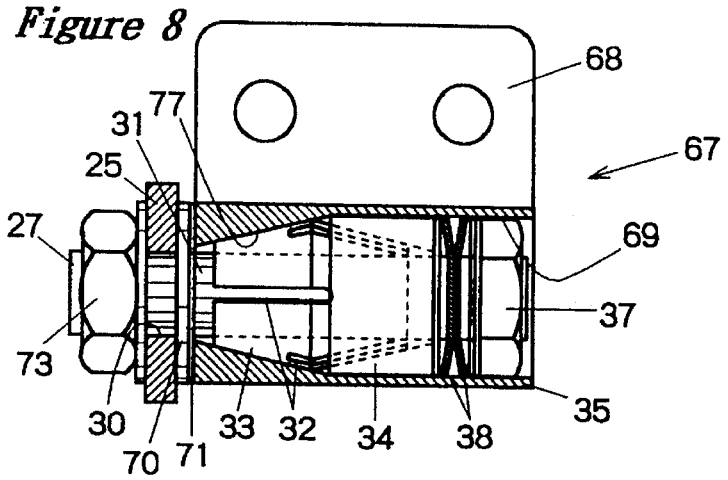
FIG. 8 is a longitudinal section view of an alternative embodiment of this invention.

FIGS. 8 to 12 illustrate another modification of this invention. An assembly 67 includes a housing 35 having a flat and rectangular portion 68. The housing 35 is made from engineering plastics. A side penetration bore 69 of the housing 35 has a fore portion 77 of a frusto-conical shape and a rear cylindrical portion. Within the housing 35, a brake sleeve 33 of a truncated biconical shape having a central aperture, and a socket 34 having a central frusto-conical aperture 74 are arranged. An elongated pivot 31 is then inserted into the housing bore 69, the sleeve and socket apertures 74 until a disc collar 70 fixed perpendicularly to the circumference of the pivot 31 can contact with the front face of the housing 35. Accordingly, the pivot 31 projects from the front face of the housing 35. The fore portion 27 of the pivot 31 extends forward from the collar 70 and generally formed to the threaded end portion 72 (see FIG. 10). FIG. 8 shows a plastic disc slider 71 placed between the collar 70 and the front face of the housing 35 in order to reduce frictional resistance. The sleeve 33 is made from engineering plastics that is excellent in durability. The sleeve 33 has a pair of three radially continuous slots 32 (see FIG. 11) which extend axially and alternately to one or other end thereof at equal circumferential distances. On the sleeve 33, the length of slots 32 is longer than one half length of the sleeve 33 and thus extend over the central thick portion 80 thereof.

An adjusting member, e.g., a nut 37 is then attached to the threaded end 75 of the pivot 31, as shown in FIG. 8. Two or more belleville springs 38 can be set on a rear portion of the pivot 31 and placed between the nut 37 and the rear face of the socket 34. To prevent the nut 37 from coming loose by frictional resistance, another plastic disc slider (not shown) may be preferably placed between the nut 37 and the spring 38. The inner surface of the bore portion 77 inclines axially in the opposite direction to the inner surface 76 of the socket 34 so that the inclined inner surface 76 can be in contact with the other frusto-conical outer surface 81 of the sleeve 33. Furthermore, the housing 35 is provided with three projecting stoppers (not shown) on the inclined inner surface 77 thereof by inserting metal pieces. The width of stopper is narrower than that of the longitudinal slot 32 of the sleeve 33 so that it can be put in the slot 32. The stoppers are defined not to come into touch with the circumference of the pivot 31. The socket 34 is partially fitted on the sleeve 33 so that the inner surface 76 of the aperture 74 can be in contact with the outer surface 81 of the sleeve 33. By means of said stoppers, the sleeve 33 turns or rests together with the housing 35 without rotating with the pivot 31, and thus the compressed sleeve 33 is effectively urged against the pivot 31.

Figure 9:
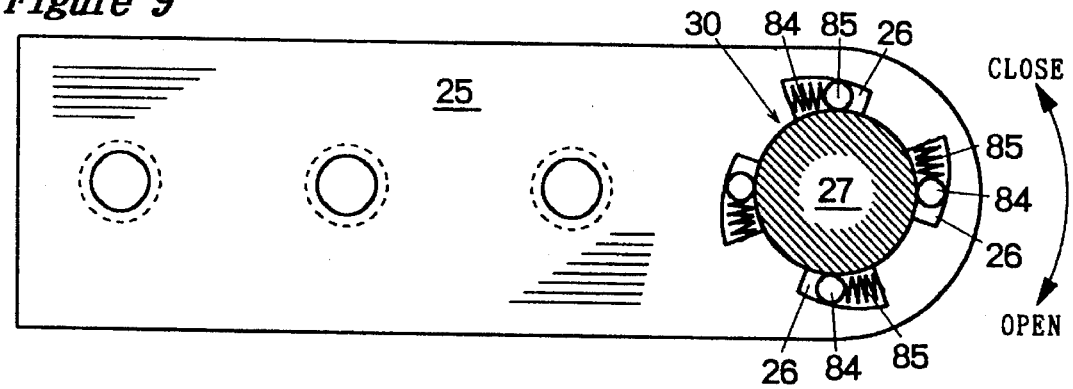
FIG. 9 is a view similar to FIG. 4, illustrating the direction of movement of a mounting plate.
Figure 10:
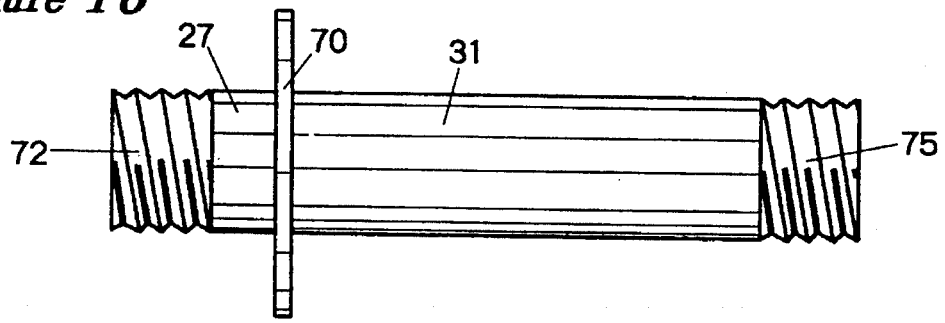
FIG. 10 is an elevational enlarged view of a pivot member shown in FIG. 8.
Figure 11:
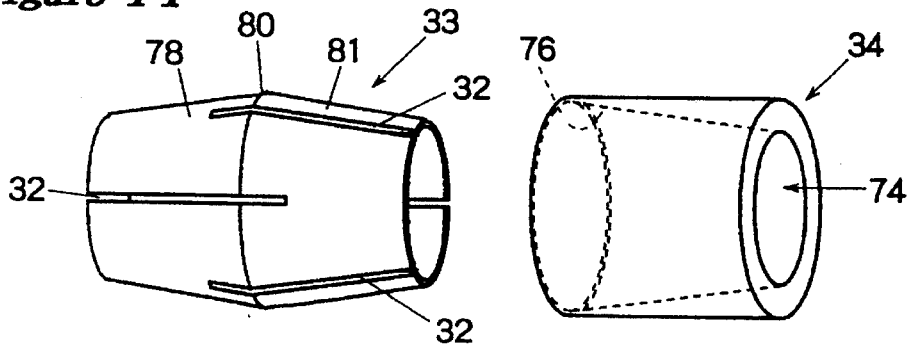
FIG. 11 is a fragmentary perspective view of a brake sleeve and a socket shown in FIG. 8.

As seen in FIG. 9, a mounting element 25 has a circular hole 30 on the end portion thereof and two or more penetration holes. The plate 25 is relatively thick. The fore portion 27 of the pivot 31 inserted into the circular hole 30, and then a nut 73 is tightened on the threaded end 72 so that the circular portion 27 is located in the aperture 30. Four recesses 26 having nearly rectangular side-view are formed on the inner periphery of the aperture 30 at equal circumferential distances. Four pairs of coiled spring 85 and roller 84 are positioned in each of the recess 26 so that each spring 85 urges the roller 84 forward.

Figure 2:
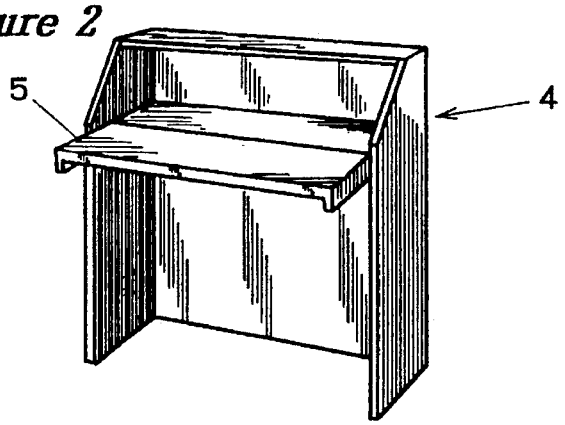
FIG. 2 is a schematic perspective view of a desk having a slant front with the assembly of this invention.
Figure 12:
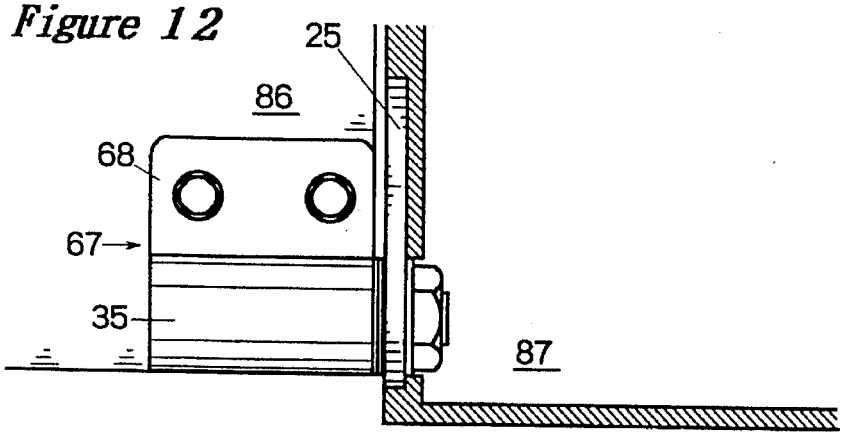
FIG. 12 is a partial horizontal section view of the desk shown in FIG. 2.

As seen in FIG. 12, the assembly 67 mounted on a first segment 86, e.g., the slant front 5 as shown in FIG. 2. As the upper portion 68 of the housing 35 has two penetration holes, the assembly 67 is bolted on the front 5. On the other hand, the plate 25 is held on a second segment 87, e.g., an adjacent side of a desk body by means of flat head screws and/or adhesive.

When opening the front 5, the housing 35, the socket 34 and the pivot 31 begin to turn simultaneously because the assembly 67 rotates with the front 5. At this time, each roller 84 is moved to the wider space in the recess 26 against the coiled spring 85, and thus the pivot 31 can rotate together with the housing 35 and socket 34. Therefore, it is possible to open freely the front 5 clockwise in FIG. 9.

When closing the front 5, the housing 35 and the socket 34 begin to turn simultaneously. At the same time as the pivot 31 begin to rotate counterclockwise in FIG. 9, each roller 84 is moved to the narrower space in the recess 26 by means of the spring 85, and thus the pivot 31 can not rotate. As the housing 35 is provided with three stoppers on the surface 77 thereof, it is certain that the sleeve 33 turns or rests together with the housing 35 when closing the front 5. Since the inner surface of the sleeve aperture is slid on the circumference of the pivot 31, the compressed sleeve 33 keeps effectively the rotation of the pivot 31 under control. The effect of the sleeve 33 which clamps down on the pivot 31 for the front 5 is easily adjustable by tightening or loosening with the nut 37.

Figure 13:
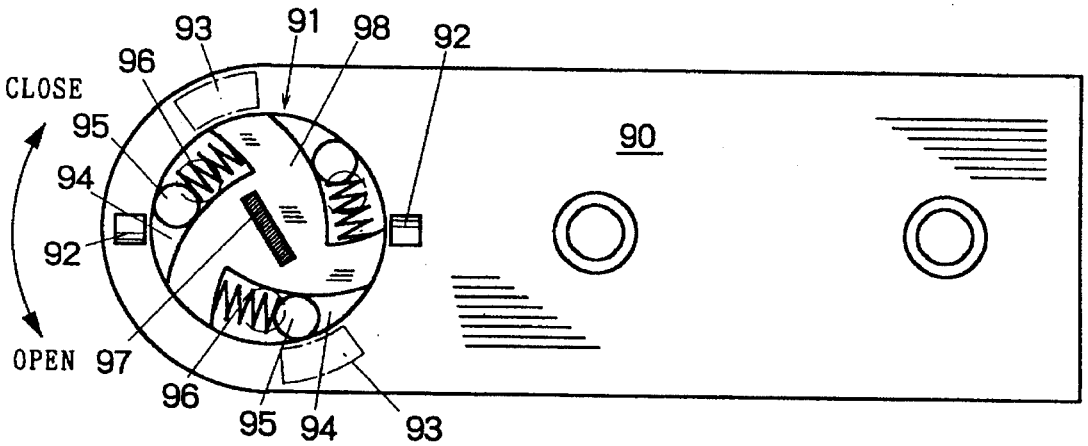
FIG. 13 is a view similar to FIG. 4, showing a third embodiment of this invention.
Figure 14:
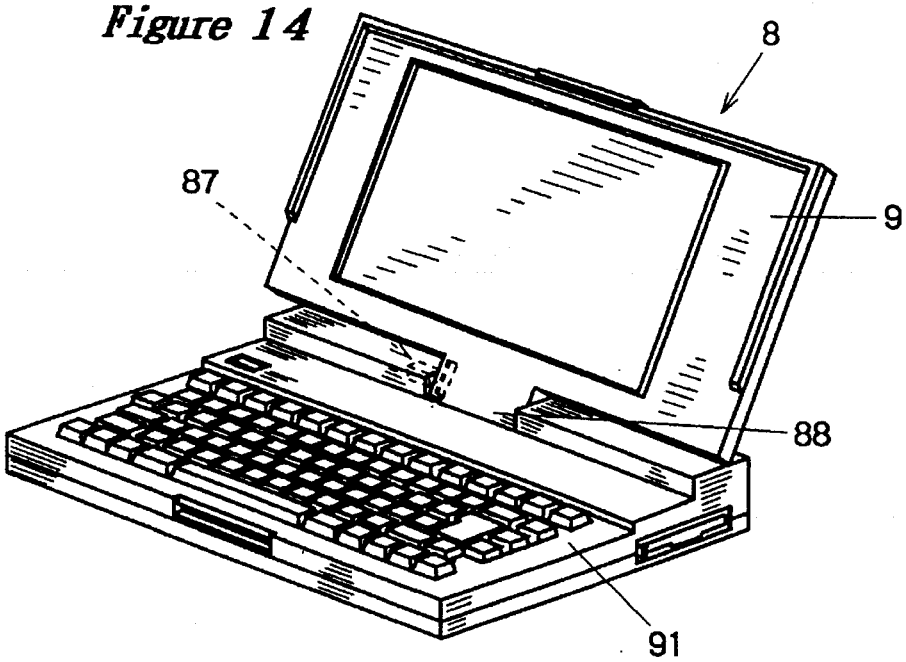
FIG. 14 is a schematic perspective view of a notebook-sized personal computer with the assembly shown in FIG. 13.

FIGS. 13 and 14 show still another modification of the invention, which is similar to that described in FIG. 4 as for a rotor disk 98 and a fore portion of a pivot and in FIG. 8 as for a control assembly with the exception that it is much small. An assembly 87 has a brake sleeve, a socket and a pivot within a housing. The housing is bolted to a first segment, e.g., a side edge of a computer body 91 of a notebook-sized computer 8. On a threaded end the pivot, there is formed to a rectangular section 97. A mounting element 90 is held on a second segment, e.g., a lower portion 88 of a display unit 9. The threaded end of the pivot inserted into a rectangular center hole of the rotor disk 98 which is located in the circular hole 91 of the plate 90. On the side surface of the plate, two flat projections 92 and 92 are formed around the circumference of the aperture 91. Two corresponding flat projections 93 and 93 are formed on the front face of the housing.

When opening the display unit 9, the housing, the socket and the pivot begin to turn simultaneously because the assembly 67 rotates with the display unit 9. The pivot can rotate together with the housing and socket, and then it is possible to open freely the display unit 9 counterclockwise in FIG. 13. When the display unit 9 opens up to 120 degrees and the projections 92 are in contact with the projections 93, respectively. At this result, the display unit 9 rests at a 120-degree opening.

When closing the display unit 9, the housing and the socket begin to turn simultaneously. At the same time as the pivot begin to rotate clockwise in FIG. 13, each roller 95 is moved to the narrower space in the recess 94 by means of the spring 96, and thus the pivot can not rotate together with the housing 35 and the socket 34. The sleeve clamps down on the pivot and rests the display unit 9 at a desired turning position.

What is claimed is:

1. A closing control and opening free assembly for a hinge connection between a first segment and a second segment, said assembly comprising:

a mounting element having a circular hole and connected to the first segment;

a pivot member with a circumference that contacts the inside surface of the circular hole;

a spring and a roller positioned in one or more recesses formed on the periphery of the circular hole so that each spring urges the roller in a forward direction;

a brake member disposed around the pivot member;

a holding member connected to the second segment and disposed around the brake member, said holding and brake members having a barrel portion and two leaf portions, said brake member being rotatable about the pivot member together with said holding member;

adjusting means for clamping the holding member against the brake member so that the brake member compresses radially into frictional contact with the pivot member.

2. An assembly as set forth in claim 1, in which the brake member is made of wear-resistant engineering plastics and the holding member is made of spring steel.

3. An assembly as set forth in claim 1, in which a lower leaf of the holding member portion extends along a tangent line of the barrel portion, and an upper leaf portion extends parallel to the lower leaf portion.

4. An assembly as set forth in claim 1, in which a rotor disk is connected to the pivot member, the circumference of the rotor disk contacting the inside surface of the circular hole, and the spring and roller being positioned in one or more recesses of the rotor disk.

5. A closing control and opening free assembly for a hinge connection between a first segment and a second segment, said assembly comprising:

a mounting element having a circular hole and connected to the first segment;

a pivot member with a circumference that contacts the inside surface of the circular hole;

a spring and a roller positioned in one or more recesses formed on the periphery of the mounting element hole so that the each spring urges the roller in a forward direction;

a brake sleeve disposed around a rear portion of the pivot member;

a socket member disposed around the rear portion of the pivot member for engaging an edge portion of the brake sleeve, said socket member with said brake sleeve being rotatable about the pivot member;

adjusting means for urging the socket member against the sleeve so that the socket member compresses the sleeve radially into friction contact with the pivot member;

and connecting means for connecting either the brake sleeve or the socket member with the second segment, said connecting means including a housing disposed around the sleeve, said connecting means preventing relative rotational movement between the sleeve or the socket member and the second segment.

6. An assembly as set forth in claim 5, in which the adjusting member includes a nut disposed around the pivot member and a spring disposed between the nut and the socket member.

7. An assembly as set forth in claim 5, in which the brake sleeve is rotatable about the pivot member and defines a central aperture and at least one slot disposed axially of the central aperture.

8. An assembly as set forth in claim 5, in which the socket member defines a central frustconical aperture and the brake sleeve includes a tapered portion which extends into the frustconical apertures of the socket member.

9. An assembly as set forth in claim 5, in which a rotor disk is connected to the pivot member, the circumference of the rotor disk contacting the inside surface of the circular hole, and the spring and roller being positioned in one or more recesses of the rotor disk.

* * * * *